United States Patent [19]

Basseches

[11] 4,223,542

[45] Sep. 23, 1980

[54] PILFER PREVENTION DEVICE

[76] Inventor: Mark T. Basseches, 420 Lexington Ave., New York, N.Y. 10017

[21] Appl. No.: 32,175

[22] Filed: Apr. 23, 1979

[51] Int. Cl.[3] ..... E05B 73/00

[52] U.S. Cl. ..... 70/58; 70/232; 70/DIG. 57; 248/553

[58] Field of Search ..... 70/58, 57, 14, 59–63, 70/232, 256, DIG. 57; 211/4; 248/553, 551

[56] References Cited

U.S. PATENT DOCUMENTS

| | | | |
|---|---|---|---|
| 1,918,093 | 7/1933 | Gang | 70/256 X |
| 3,765,197 | 10/1973 | Foote | 70/DIG. 57 X |
| 3,859,826 | 1/1975 | Singer et al. | 70/58 |
| 4,004,440 | 1/1977 | Dreyer | 70/58 X |
| 4,066,231 | 1/1978 | Bahner et al. | 70/58 X |

*Primary Examiner*—William E. Lyddane

*Attorney, Agent, or Firm*—Mark T. Basseches; Paula T. Basseches

[57] ABSTRACT

The present invention relates to a pilfer prevention device adapted to be readily connected between an article to be secured, such as a television set, typewriter, etc. and a fixed location so as to discourage unauthorized removal. The device includes a mounting assembly readily connectible to the article, an elongate cable assembly extending therefrom, and a mounting fixture adapted to be connected to a desk, table or like fixed object. The device is characterized by lockable release means on the mounting assembly which, in the locked position, prevents access to the fastening means by which the apparatus is connected to the fixed object and to the article to be protected.

7 Claims, 2 Drawing Figures

PILFER PREVENTION DEVICE

BACKGROUND OF THE INVENTION

1. Field of the Invention

The present invention is in the field of security devices, and more particularly pertains to an antipilfer device intended for use in stores, offices and homes as a means for safeguarding portable items, such as typewriters, radios, stereo equipment and the like against abstraction by sneak thieves.

2. The Prior Art

The loss by theft from office buildings, homes and stores of appliances such as radios, typewriters and stereo equipment is widespread. In many instances the thefts are of the so-called sneak or impulse type where an individual seeing an unguarded appliance in a store or office will simply abstract the article when the thief is confident he is not being observed. Theft of this sort is extremely prevelant in stores wherein a multiplicity of appliances are necessarily displayed in an accessible environment to permit customers to inspect and handle the same. While various complex apparatuses have been designed to sound alarms or otherwise indicate an attempt to abstract an item, installations of the noted sort have been expensive and the connection and disconnection of the article have been cumbersome.

Attempts have been made to safeguard appliances through the use of chains, padlocks and the like. However, in addition to the unaesthetic appearance of such expedients, it is often difficult to mount an anchoring fixture for reception of one end of a chain, leash or the like to an appliance without disfiguring the same.

SUMMARY OF THE INVENTION

The present invention may be summarized as directed to an anti-theft device intended for use in environments where a sneak or impulse thief is unlikely to be able to resort to the use of burglar tools for fear of detection. The device is characterized by its ability to be readily installed by an unskilled individual, such as to permit a wide range of movement of the article but to prevent removal thereof except by one in possession of means, such as a key, to operate the locking mechanism incorporated therein.

The device includes a locking mechanism, an anchor or fixture mechanism, and a control cable assembly extending between the same. The locking mechanism includes a mounting aperture accessible in the open position of the locking mechanism whereby a bolt, screw or the like, which preferably may be an existent bolt forming a part of the article to be protected may be passed through the locking mechanism and back into the appliance. The fixture includes a mounting plate likewise defining an aperture, which aperture may be secured to a fixed object at a position remote from the appliance.

Both the locking mechanism and the mounting fixture are provided with shutters or shields which, in the open position, provide access to the mounting screws supporting the same respectively to the appliance and the fixed object.

In the locked position, the shutters shield the mounting screws, whereby removal of the screws cannot be effected.

Accordingly, it is an object of the present invention to provide an inexpensive theft deterrent device adapted to be readily interposed between an article to be protected and a fixed object whereby, after installation, one not in possession of a key can remove the appliance only through the use of burglar tools or like instruments which cannot surreptitiously be employed by a sneak thief.

A further object of the invention is the provision of a device of the type described which is inexpensive to manufacture and simple to install and remove.

Still a further object of the invention is the provision of a device of the type described which may normally be installed without the necessity for drilling holes or otherwise defacing an appliance, utilizing for connection to the appliance mounting bolts, screws or like connectors already existing on the device to be protected.

Still a further object of the invention is the provision of a device of the type described wherein, if the appliance is abstracted through the use of burglar tools, removal of components remaining on the appliance will leave a tell-tale scarring, marring or disfiguring of the appliance, such as to make a prospective purchaser of the appliance from the thief suspicious of the fact that the appliance has been stolen and not lawfully obtained.

To attain these objects and such further objects as may appear herein or be hereinafter pointed out, reference is made to the accompanying drawings, forming a part hereof, in which.

Figure 1:
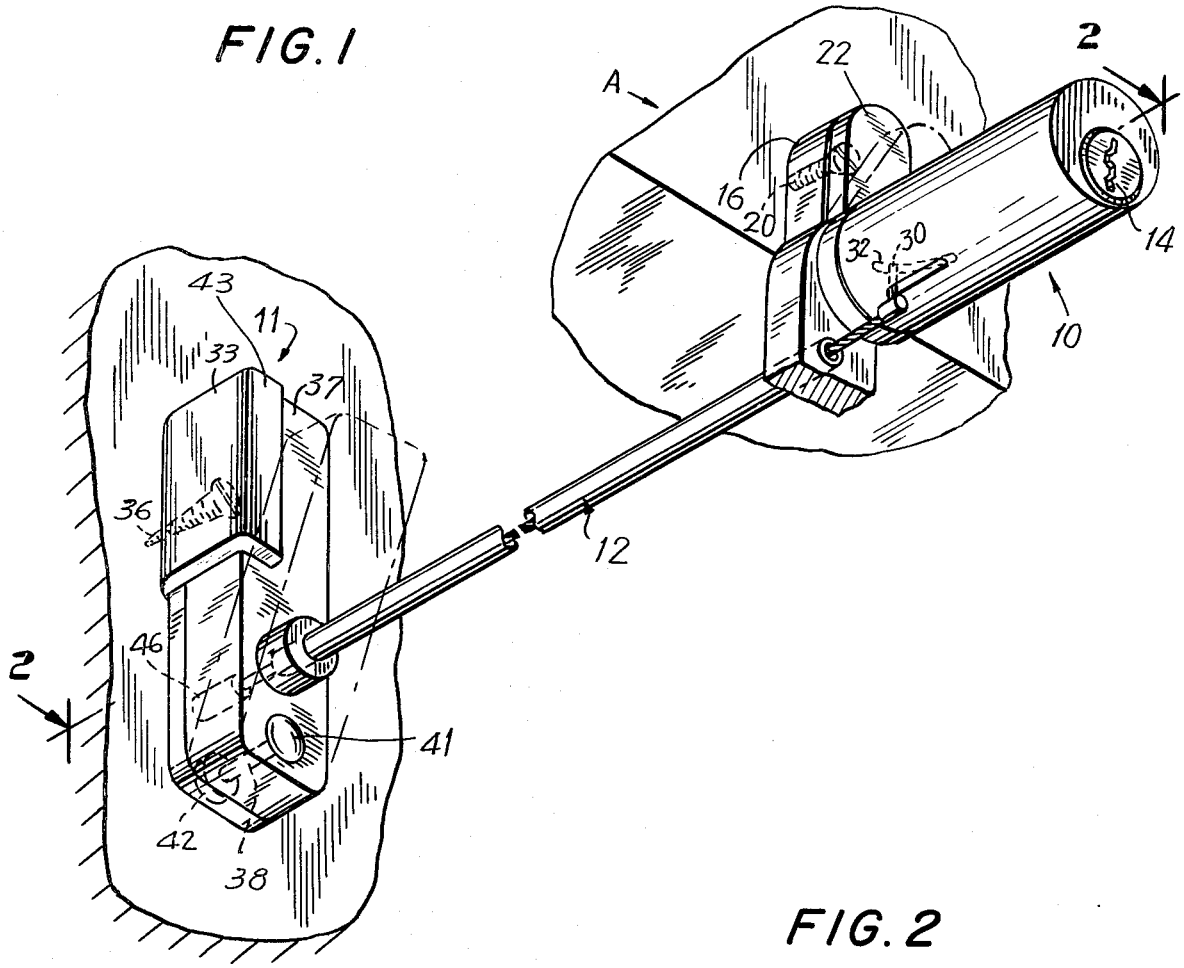
FIG. 1 is a fragmentary perspective view of an apparatus in accordance with the invention.

Referring now to the drawings, there is shown in FIG. 1 a pilfer resistant assembly comprising generally a lock housing 10, a mounting or anchor fixture 11 and a shielded operator cable assembly 12 connecting the lock housing and the mounting fixture.

Figure 2:
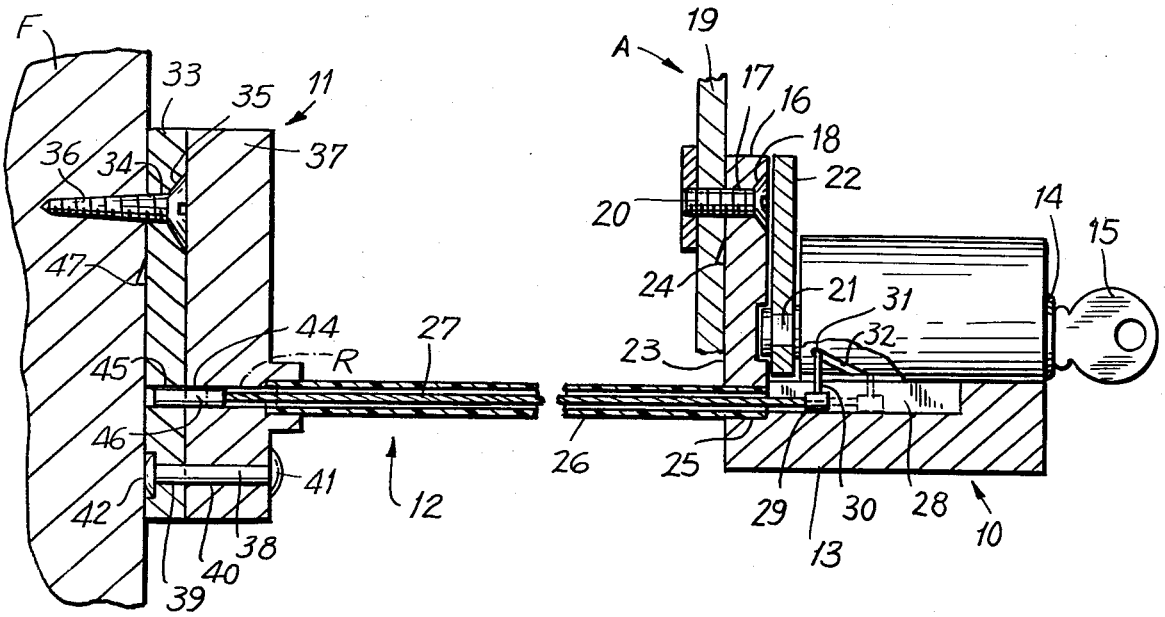
FIG. 2 is a horizontal sectional view of the apparatus taken on the line 2—2 of FIG. 1.

As best seen in FIG. 2, the housing 10 may include a lock body 13 including a key rotatable lock plug 14 of the pin tumbler, disk tumbler or like type. Illustratively the lock plug may be operated by a key 15 in conventional manner, it being understood that the locking mechanism may alternatively be of the combination or other type wherein rotation relative to the housing is restricted to those having possession of the key or knowledge of the combination.

The housing 10 includes a mounting plate 16 provided with a through-going mounting aperture 17. The aperture 17 includes a recessed or countersunk entry portion 18, preferably of exaggerated size to provide clearance for the heads of any of a variety of connector members. The plate 16 is intended to be mounted to a portion of an appliance A, illustratively to the chassis 19 of a television set or the like.

Normally devices such as appliance A will include one or more exposed bolts, screws or like connector members 20 which function to connect portions of the appliance to other portions of the appliance. Obviously, in the event that the appliance contains no such exposed connector members, a screw or like connector may be substituted by being passed through the aperture 17.

The rotatable plug member 14 includes a driver cam 21 having a cover member 22 affixed thereto. As will be observed from an inspection of FIG. 1, the cover member 22, in the locked position, overlies the aperture 17 and prevents access thereto. However, one in possession of a key 15 may rotate the cover member 22 to the dotted line position shown in FIG. 1, whereby the aperture is exposed, permitting mounting of the apparatus by backing the bolt 20 out of apparatus, passing it through the aperture 17, and reinserting the same into the appliance.

Preferably, the mounting plate 16 may include on its front face 23 a spur member 24 which, upon tightening of the bolt 20, becomes embedded in the appliance wall 19 so as to prevent relative rotation after the plate has been clamped in position by retightening of the bolt. As will be understood, alternative means for preventing relative rotation may be employed.

The lock housing 13 forms an anchor point for one end 25 of the shielded cable assembly 12, the cable assembly including a sheath 26, preferably armored, and an operator portion 27. Means are provided in the lock assembly 10 for shifting the operator portion 27 of the cable assembly 12 responsive to rotation of the lock plug 14.

As shown in FIG. 2, the housing 13 is provided with an axially directed guide groove 28. The end 29 of the operator portion 27 is provided with a follower finger 30 slidably movable within the groove 28. The upper end 31 of the finger 30 extends into a helical groove 32 formed on a downwardly directed peripheral surface of the lock plug 14.

It will be observed that when the plug is rotated in a clockwise direction, the finger 30 riding in the groove 32 will induce an axial movement of the finger to the right to the dotted line position shown in FIG. 2. The shifting movement will be communicated to the operator portion 27 of the cable assembly 12. Return movement of the locking mechanism will induce a concomitant leftward movement of the finger and the operator portion 27 to which it is attached. It will be understood that alternative means for shifting the cable, such as a pinion fixed to the lock plug engaging a rack connected to the operator portion 27 may be suitably substituted for the cam arrangement illustrated.

The fixture or anchor assembly 11 is comprised of a mounting plate 33 having a through-going mounting aperture or apertures 34 which are countersunk, as at 35. In order to mount the fixture 11, a screw, bolt or like connector 36 is passed through the aperture 34 and secured into a fixed object F, such as a wall, floor, desk, etc. Alternatively, the cover plate mounting bolt of an electrical outlet may be backed off, passed through the aperture and reinserted into its normal position.

The mounting plate 33 pivotally carries a shutter member 37, pivotal connection between such parts being provided by a pivot pin 38 passed through registering apertures 39, 40 in the plate and shutter, respectively. The pin 38 is headed at both ends, as at 41 and 42, after insertion so as permanently pivotally to connect the shutter and the plate. Preferably, the plate 33 may include an L-shaped flange member 43 which outwardly laps the shutter so as to prevent prying of the shutter away from the plate 33 in the locked position.

The shutter 37 and the plate 33 are provided with registering locking apertures 44, 45, respectively, which apertures are disposed in alignment in the locked position of the shutter (FIG. 2 and the solid line position, FIG. 1).

The operator portion 27 of the cable assembly 12 includes a hardened locking slug 46 sized to be slidable within apertures 44, 45.

Operation of the device will be apparent from the preceding description.

In order to mount the apparatus, the authorized owner, utilizing key 15, rotates the plug 14 to withdraw the finger 30 and consequently the operator portion 27 of the cable and the slug 46 to the dotted line or release position R shown in FIG. 2.

Additionally, actuation of the lock shifts the cover member 22 in a clockwise direction, exposing the mounting aperture 17 on the lock housing. As a result of withdrawal of the slug 46 to the position R, clockwise pivoting of the shutter member 37 to the dotted line position shown in FIG. 1 is permitted, whereby the mounting aperture 34 may be exposed.

With the parts thus positioned, the device may be secured between an appliance and a fixed object by attaching either of the fixture or the lock housing to one such member, the unattached component being connected to the other. Normally it will be preferred that the lock housing be secured to the appliance as by removing and replacing the bolt member 20, as previously described. With the housing and fixture thus mounted, the shutter member is shifted into overlying position of the mounting plate 33 of the fixture and the key 15 rotated to the locking position. When thus disposed, the slug 46 will be shifted leftwardly, spanning the junction between shutter 37 and mounting plate 33.

With the parts thus positioned, it will be clear that neither of the mounting connectors 20 or 36 will be accessible and, accordingly, the appliance protected can be removed by an unauthorized individual only by severing the shielded cable assembly 12. Obviously, the degree of security afforded is dependent upon the strength of the cable.

Preferably, the mounting plate 33 may include a spur 47 which, in the mounted position of the plate, is indented into the fixed surface so as to preclude relative rotation and consequent unfastening of the screw 36.

From the foregoing it will be recognized that there is disclosed an inexpensive pilfer resistant apparatus adapted to be readily connected between an appliance to be safeguarded and a fixed object, such as a table, shelf or the like, or to a structural member. The apparatus may be readily applied, in most cases utilizing already existing connector mechanisms, such as bolts or the like on the appliance, or by substituting somewhat longer bolts to accommodate for the additional thickness of the plate 33.

It will be further observed that even if a device is abstracted by severing the cable, the lock mechanism will remain fixedly positioned to the appliance and removal of the same will require either destruction of the lock mechanism or disfigurement of the appliance, whereby its resale value is greatly reduced since the purchaser thereof is alerted to the fact that the device has been stolen.

It will be obvious to those skilled in the art that numerous structural variations may be made in the form of the embodiment illustrated and described without departing from the spirit of the invention. By way of example and without limitation, the specific mechanism for shielding the mounting connection portions of the fixture and of the lock member, the mechanism for inducing movement of the operator member of the cable, the means for locking the shielding members in place, and the like, all may be modified to effect similar results without departing from the spirit of the present invention, which is to be broadly construed within the scope of the appended claims.

Having thus described the invention and illustrated its use, what is claimed as new and is desired to be secured by Letters Patent is:

1. Anti-pilferage device comprising a lock housing including a mounting portion having a mounting aperture, lock means on said housing shiftable between locking and unlocking positions, a cover member operatively connected to said locking means, said cover member being disposed in shielding position of said aperture in said locked position and in exposing position of said aperture in said unlocked position of said locking means, an elongate cable assembly having a first end fixed to said housing and having a free end, said assembly including an enclosed movable operator portion connected to said lock means and movable relative to other portions of said assembly responsive to movements of said lock means, an attachment fixture secured to said free end of said cable assembly, said fixture including a mounting plate having a mounting aperture formed therein, shutter means mounted on said fixture and shiftable between blocking and unblocking positions of said aperture, and shutter control means operatively associated with said operator portion of said cable assembly adjacent said free end for locking said shutter means in said blocking position when said lock means is in said locked position and releasing said shutter means for movement to said unblocking position when said lock means is in said unlocked position.

2. A device in accordance with claim 1 wherein said shutter is pivotally mounted on said fixture and said shutter control means keys said shutter to said fixture in said locked position and is retracted from said keyed position in said unlocked position.

3. Apparatus in accordance with claim 1 wherein said shutter is disposed adjacent a first face of said plate, the other face of said plate including means for resisting relative rotation between said plate and a surface against which said plate is clampingly engaged.

4. Apparatus in accordance with claim 3 wherein said means for resisting relative rotation comprise a spur extending from said other face of said plate.

5. Apparatus in accordance with claim 3 wherein said mounting portion includes means for resisting relative rotation between said housing and a surface against which said mounting portion is clampingly disposed.

6. Apparatus in accordance with claim 3 and including a flange member formed on said plate in spaced relation to said plate, said shutter being disposed between said plate and said flange member in said locked position.

7. Apparatus in accordance with claim 1 where said housing includes a slot, said lock means is rotatably mounted in said housing and includes a cam in registry with said slot, and said operator portion includes a follower member engaging said cam.

* * * * *